US005599258A

United States Patent [19]

Stone et al.

[11] Patent Number: 5,599,258

[45] Date of Patent: Feb. 4, 1997

[54] ADJUSTABLE EXERCISE STEP AND METHOD

[75] Inventors: Michael R. Stone, Elgin; Mark S. Henriksen, Columbia, both of S.C.

[73] Assignee: The Firm, Inc., Columbia, S.C.

[21] Appl. No.: 311,556

[22] Filed: Sep. 23, 1994

Related U.S. Application Data

[63] Continuation-in-part of Ser. No. 58,467, May 6, 1993, abandoned.

[51] Int. Cl.[6] ..... A63B 5/00

[52] U.S. Cl. ..... 482/52; 482/51; 297/440.1

[58] Field of Search ..... 108/110, 19, 144, 108/156; 297/439; 482/51–52, 108, 144; 182/15; 248/161; 147/3; 5/431

[56] References Cited

U.S. PATENT DOCUMENTS

| | | | |
|---|---|---|---|
| 314,831 | 3/1885 | Hardy | 108/144 |
| 3,179,071 | 4/1965 | Johnston | 108/144 |
| 3,606,458 | 9/1971 | Attinger | 297/439 |
| 4,624,341 | 11/1986 | Lee | 297/461 |
| 5,118,095 | 6/1992 | Flor | 482/52 |

*Primary Examiner*—Jerome Donnelly
*Attorney, Agent, or Firm*—Ralph Bailey

[57] ABSTRACT

A step for aerobic exercise has a stationary base support (A) carrying in telescopic relation, an upper member (B) which is manually moveable for making height adjustments by selectively engaging interlocking elements (C) and (D) carried by the stationary support, and the moveable upper member respectively so that a user may approach the step from any direction for exercising or for making height adjustments by moving the upper member (B) engaging and disengaging the interlocking elements by manipulating the vertical and horizontal positioning of the upper member with respect to the stationary member.

12 Claims, 6 Drawing Sheets

Fig. 4.
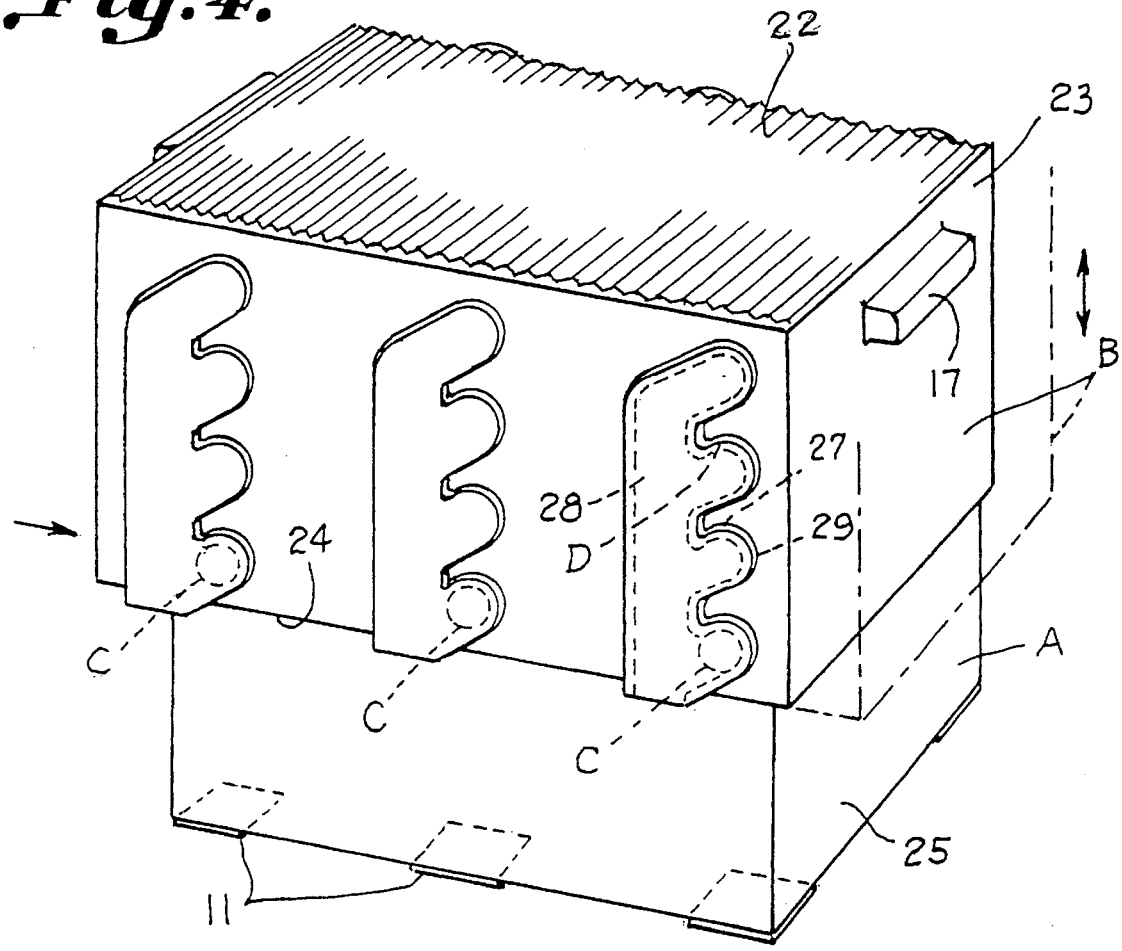
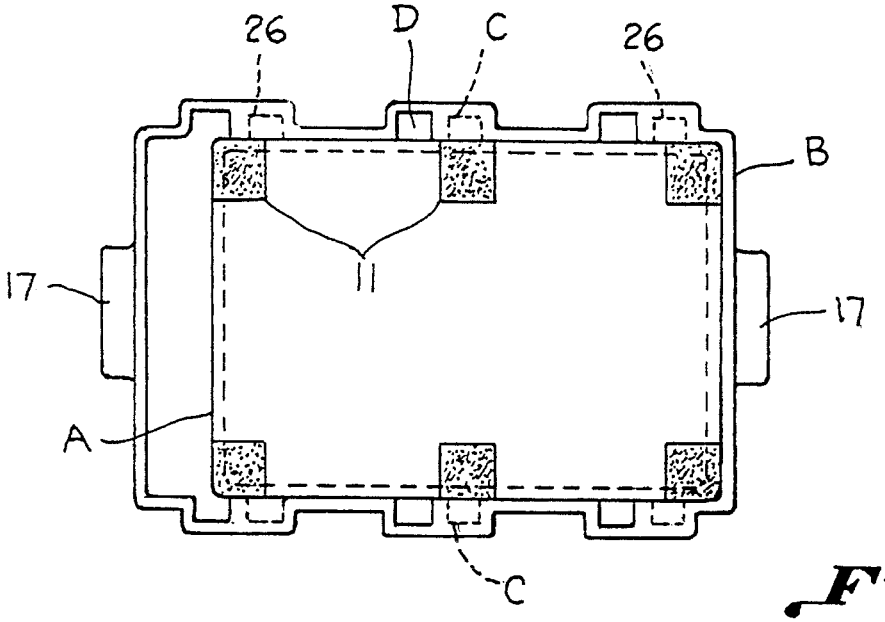
Fig. 5.

ADJUSTABLE EXERCISE STEP AND METHOD

This is a continuation-in-part application of application Ser. No. 08/058,467, filed May 6, 1993 entitled ADJUSTABLE STEP FOR AEROBIC EXERCISE AND METHOD now abandoned.

BACKGROUND OF THE INVENTION

This invention relates to an adjustable step for aerobic exercise and method wherein interlocking elements are engageable and disengageable by manual manipulation of an upper member carried in telescopic relation opposite a stationary support so that the step is approachable from any direction for exercising and for height adjustment.

Interlocking elements have been provided heretofore for adjusting seats such as illustrated in U.S. Pat. Nos. 272,825 and 668,038. U.S. Pat. No. 166,628 illustrates a vertically adjustable chair wherein the height adjusting members engage but do not interlock so that a twisting force may cause the seat to be inadvertently abruptly lowered in respect to a base member. U.S. Pat. No. 1,855,245 illustrates an adjustable seat suitable for use in automobiles having spaced interlocking members for securing vertical adjustment through a number of upwardly inclined slots in respect to a pin or stop member extending outwardly from an upper base member.

Adjustable exercise steps are illustrated in U.S. Pat. No. 5,037,084 wherein a base member has a number of grooves on axes extending through the center to receive a plurality of tongues to adjust an upper member with respect to the base in a raised or lowered position. U.S. Pat. Nos. 5,050,861 and 5,176,596 illustrate telescopically mounted boxes which may be moved to be received at several levels by blocks carried by a base member.

U.S. Pat. Nos. 5,096,186 and 5,116,004 illustrate steps wherein an upper member has a reverse mounting which permits height adjustments.

Thus, the exercising steps of the prior art permit only limited adjustment and are of relatively cumbersome construction wherein limited adjustments may be made with difficulty. The seat constructions have upper surfaces with limited accessibility and are unsuited for use as exercise steps. Moreover, the steps are not accessible for ready height adjustment.

SUMMARY OF THE INVENTION

Accordingly, it is an important object of this invention to provide an adjustable step for use in aerobic exercising which is approachable from any direction and which may be manually adjustable for a number of height adjustments.

Another important object of the invention is the provision of a method for adjusting the height of a step for facilitating aerobic exercises thereon including providing an upper moveable member carried by a stationary support. By manually moving the upper member vertically and then horizontally on the stationary support interlocking vertical positioning of the moveable upper member in respect to the stationary support may be achieved. The upper member may be manually rotated or moved in a lateral translating motion in order to effect horizontal movement with resulting engagement and disengagement of interlocking elements.

Another object of the invention is to provide interlocking elements for effecting vertical adjustment between a stationary support and a moveable upper member wherein a number of upwardly inclined vertically spaced slots receive outwardly projecting means carried by the stationary support for providing interlocking adjustable positioning of the moveable upper member on the stationary support.

Another important object of the invention is the provision of an adjustable step especially suitable for aerobic exercising wherein an upper member has an open bottom receiving a stationary lower support therein for accommodating vertical movement and translatory movement at an angle thereto for effecting interlocking engagement of elements carried respectively by the upper and lower members.

Another object of the invention is to provide an adjustable step which is essentially cylindrical and has a lower member which is telescopically received within an upper member and which carries inclined surfaces for interlocking engagement with a complementary interlocking member extending outwardly from a lower stationary support.

Still another important object of the invention is the provision of a cylindrical aerobic exercise step having telescoping parts of simplified construction wherein the parts are moved vertically and rotated relative to each other for simplified positive height adjustment of an upper step.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 4 illustrates a perspective view of a modified form of the invention wherein a rectangular step is illustrated and wherein the step is elongated and makes provision for lateral translatory movement of an upper telescopically mounted member upon a base support having outwardly extending interlocking elements spaced thereabout;

FIG. 5 is a bottom plan view of the adjustable step illustrated in FIG. 4;

DESCRIPTION OF A PREFERRED EMBODIMENT

The drawings illustrate a height adjustable step for facilitating aerobic exercises. A stationary support A includes a base and an upwardly extending frame carried by the base. A moveable upper member B includes a flat foot receiving upper step surface. A depending mounting member carries the upper member in telescopic relation over the upwardly extending frame carried by the base so as to be supported thereby at adjusted vertical positions thereon. Interlocking elements C and D are spaced about and are carried by the upwardly extending frame and the depending mounting member respectively. The interlocking elements are engageable and disengageable responsive to movement of the upper member B by the user on the stationary support A at multiple vertical positions about the step for varying the height of the depending mounting member upon the upwardly extending frame. Thus, substantially unobstructed access may be had in any direction by the user to an upper step surface which is adjustable in height for varying the exertion expended by the user in exercising.

The method includes effecting a vertical adjustment by raising the telescopically mounted upper member and then effecting a translatory movement in generally horizontal or rotating motion so as to cause an interlocking engagement with an upper inclined surface. The upper telescopic member may be raised or lowered and then turned or moved horizontally to effect interlocking engagement between outwardly projecting interlocking elements carried by the lower base and an inner surface of the upper member for effecting vertical adjustment which will remain interlocked unless an upwardly force is manually exerted against the upper step portion of the assembly.

Figure 1:
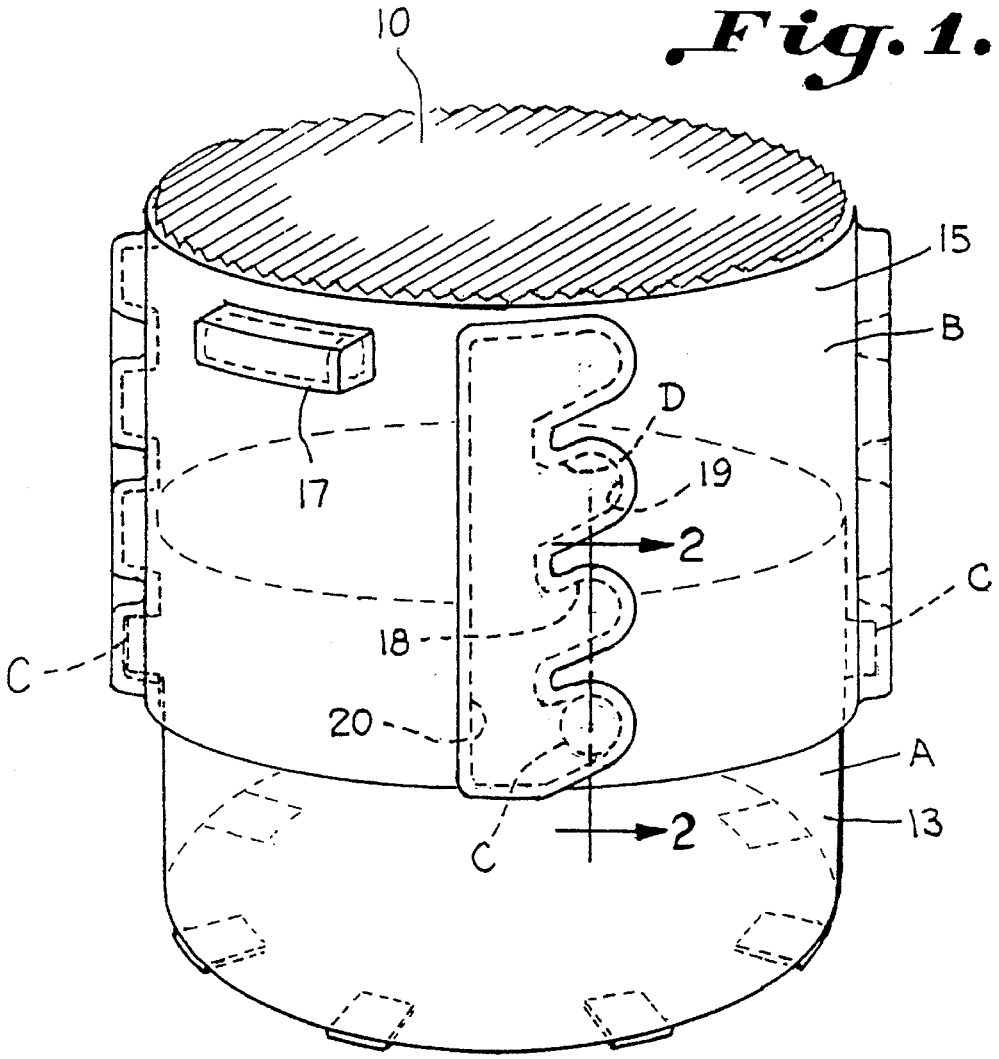
FIG. 1 is a perspective view illustrating an adjustable step which is essentially cylindrical for facilitating aerobic exercises and having an upper member which is vertically moveable by manual adjustment for effecting height adjustments.
Figure 2:
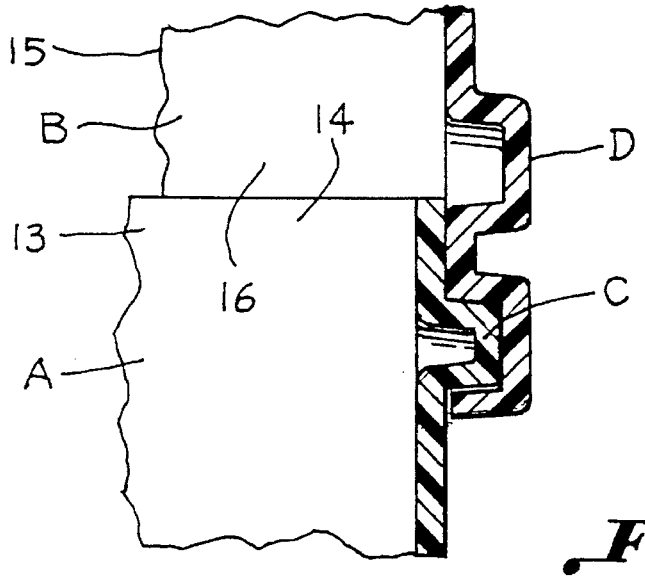
FIG. 2 is a transverse sectional elevation taken on the line 2—2 in FIG. 1 illustrating interlocking elements for effecting height adjustments.
Figure 3:
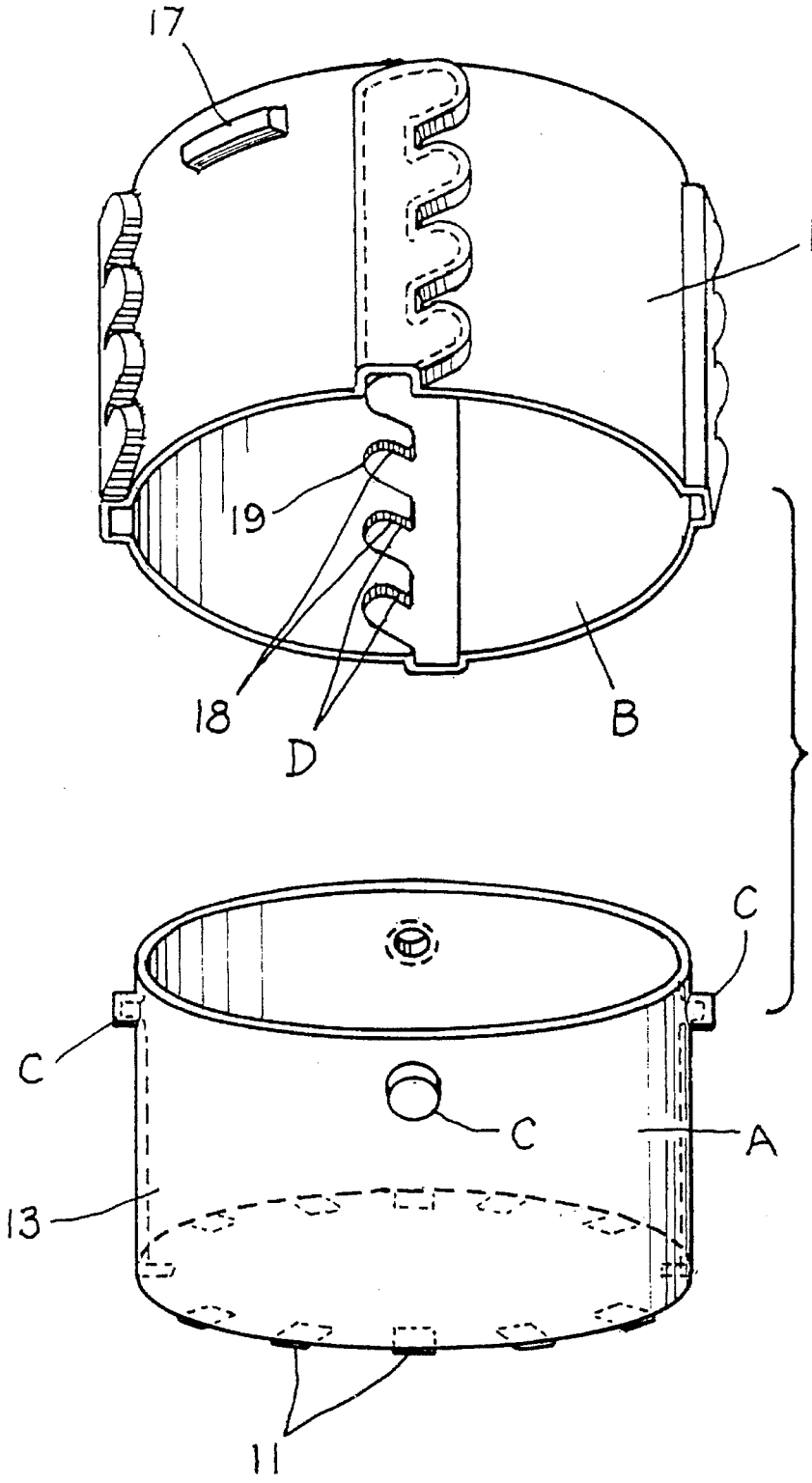
FIG. 3 is a perspective view having an upper moveable member telescopically receiving a lower base support but which is removed therefrom illustrating the inner surfaces of the interlocking element carried by upper moveable elements as well as the interlocking elements projecting outwardly from the lower stationary support.

FIGS. 1, 2 and 3 illustrate a cylindrical step assembly which includes an upper step surface including a rubber pad 10 which may be textured to improve the frictional characteristics for engagement by the feet of the user. The stationary support A includes a plurality of circumferentially spaced rubber feet 11 for providing frictional engagement between a base portion 12 and the upwardly extending frame 13. The upwardly extending frame has an open top 14 for receiving any article the user may wish to store into the stationary support A. The moveable upper member B in addition to the flat foot receiving upper step surface 10 has a depending mounting member 15 having an open bottom 16 for telescopically receiving an upwardly extending frame 13. It will be noted that a plurality of handles 17 may be spaced about the manually upper member B for manually engaging the upper member B to effect vertical adjustment.

The interlocking elements C and D are carried respectively between the upwardly extending frame 13 and by the depending mounting member 15 respectively. Interlocking element C is illustrated in FIGS. 1–3 in the form of a protuberance or pin C which projects outwardly from the upwardly extending frame member so as to be received in bearing relation to an upwardly inclined surface 18 formed by each of a plurality of vertically spaced slots which comprise an interlocking element D. The slots have curved ends 19 at an upper terminus. The other ends of the slots are connected by a vertical guiding slot 20 to facilitate guiding upward movement of the moveable upper telescopic mounted member.

FIGS. 4 and 5 illustrate an essentially elongated rectangular box-like step wherein an adjustable moveable upper member B is telescopically carried by a stationary support A. The moveable upper member B includes a flat foot receiving upper surface 22 carried by a depending mounting member 23 which has an open bottom 24 for reception of the stationary support A therein. The depending mounting member 23 is carried over the upwardly extending frame 25 in telescopic relation by the stationary support A so that the interlocking elements C and D are carried opposite each other to effect positions of vertical adjustment. The interlocking elements C are provided in the form of protuberances or pins 26 carried within vertically spaced upwardly inclined finger-like slots 27 which are joined at their free ends for vertical slots 28. The pins 26 are received in interlocking engagement by the upper upwardly inclined surfaces of the slots 27 and annular end portions 29 provided for holding the pins in interlocking engagement.

As is the case with the embodiment illustrated in FIGS. 1 through 3, the embodiment illustrated in FIGS. 4 and 5 may effect height adjustment by a first lateral movement, in this case laterally of the upper moveable member B in respect to stationary support A and then effect a translatory movement, in this case laterally, to permit upward or downward adjustment by vertical movement of the slots in respect to the pin C. It will be observed that the lateral movement is provided by making the moveable upper member somewhat more elongated so as to overhang the lower stationary support on one end while permitting movement to dotted line position illustrated in FIG. 4 in order to effect disengagement of the interlocking element.

Figure 6:
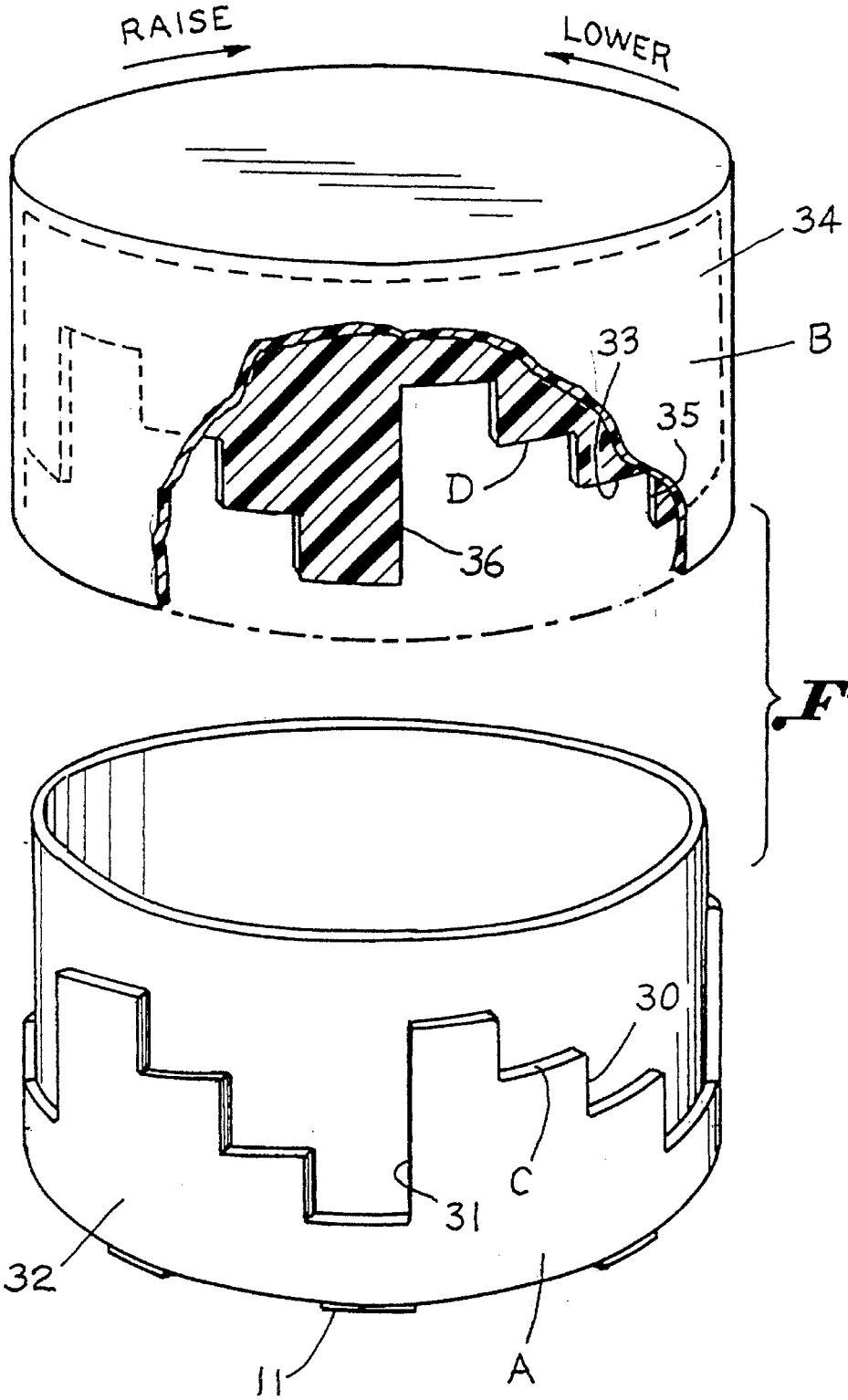
FIG. 6 is a perspective view illustrating another modified form of the invention wherein a generally cylindrical adjustable step is provided having inclined interlocking surfaces arranged in stair steps.

FIG. 6 illustrates another modified form of the invention wherein a generally cylindrical adjustable step is provided wherein interlocking elements C and D respectively include stair steps upwardly inclined surfaces so that one or more of the respective interlocking surfaces may be engaged to effect height adjustments through rotating the upper moveable member on the stationary support A. The stair step interlocking element C includes risers 30 and elongated upper member defining a slot as at 31. These interlocking elements extend outwardly of an upwardly extending frame 32 whereas stair step upwardly inclined surfaces 33 are carried inwardly of a depending mounting member 34 carried by the upper moveable member B. Complementary risers are illustrated at 35 as well as vertical surfaces which defines a vertical slot at 36.

Any number of variations are possible as where multiple vertically spaced pins or upwardly extending slots may be utilized in lieu of the pins or stair steps C.

Figure 7:
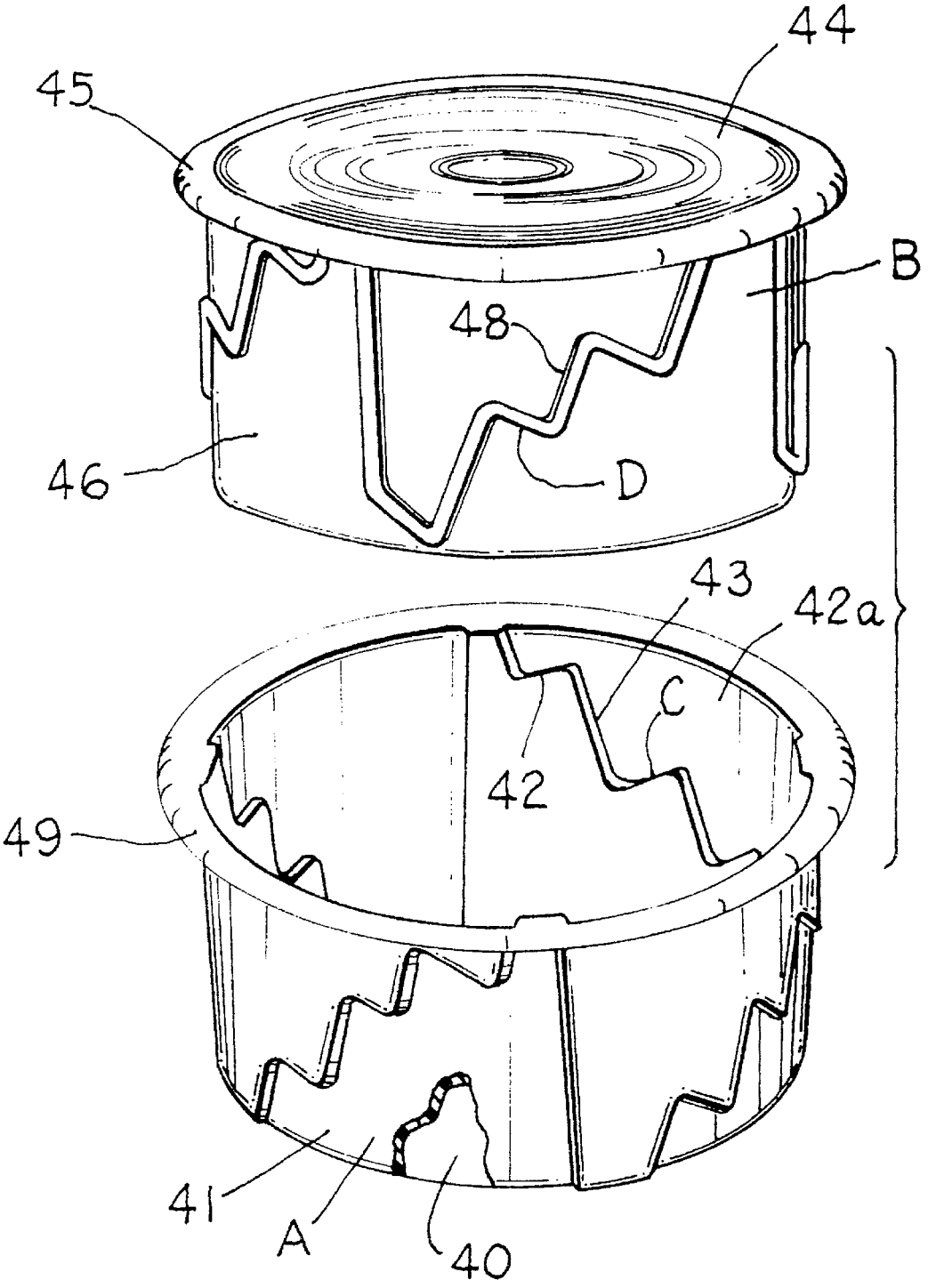
FIG. 7 is a perspective view illustrating a modified form of the invention wherein an upper portion may be lifted and rotated in respect to a lower based portion into which it is manually inserted in telescoping relation.
Figure 9:
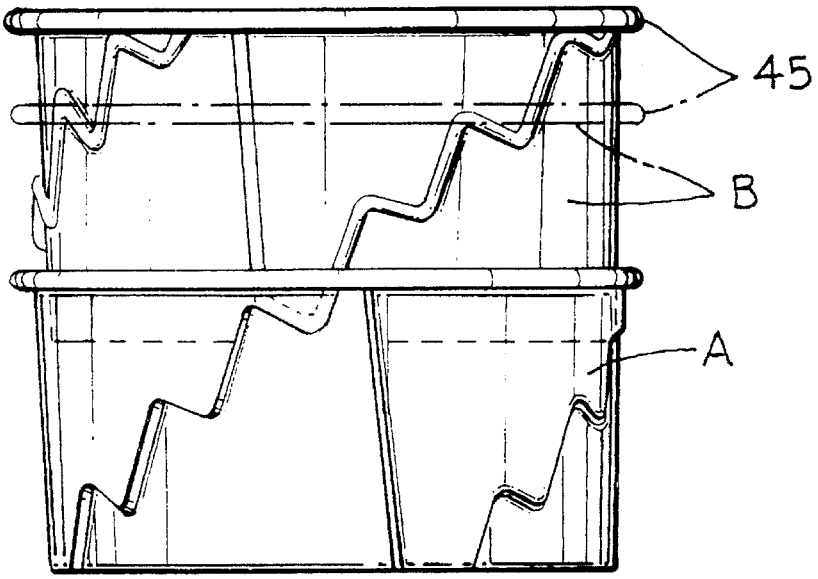
FIG. 9 is a side elevation illustrating the step of FIGS. 7 and 8 with the parts fully extended in an adjustable position, and shown in broken lines in an intermediate position slightly less than fully raised position.
Figure 8:
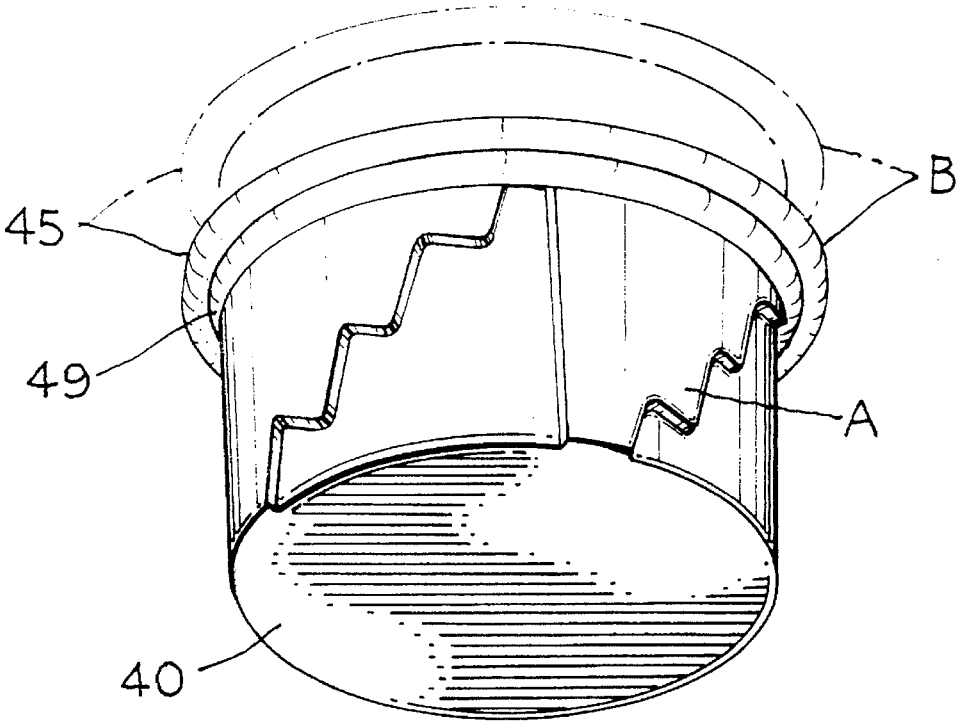
FIG. 8 is a bottom perspective view illustrating the parts in fully nested position with an initial elevated position illustrated in broken lines.

Referring more particularly to FIGS. 7–9, another modified form of the invention is illustrated wherein a stationary base support A includes a bottom or base 40 in an upwardly extending cylindrical frame 41 extending upwardly from the bottom or base and having interlocking elements C on interior portions thereof extending inwardly from an inner wall 42*a* of the cylindrical frame 41 the form of engaging portions which have inclined steps 42 extending slightly downwardly and rearwardly while upwardly extending riser portions 43 are substantially upright and extend slightly rearwardly as at 43 until it intersects a forward edge of a next succeeding step portion 42 which is spaced rearwardly of the succeeding step portion. A cylindrical movable upper member B includes a flat foot receiving surface which may be textured as at 44. The textured part 44 is carried by a slightly larger step member 45 which extends slightly outwardly thereof acting as a support for the textured portion 44. The movable upper portion includes a depending mounting member 46, having an open bottom, which telescopes within the cylindrical member 41 and carries interlocking members D having substantially horizontal forwardly and downwardly extending portions 47 for interlocking with a corresponding step member 42 while one or more substantially vertical riser portions 48 abut the portions 43 for firm interlocking engagement. It will be observed that the upwardly extending frame 41 carries outwardly extending modular portions 49 for supporting the outwardly extending member 45 carried by the movable upper member B.

By referring again to FIGS. 7–9, it will be observed that a fully raised position for the movable upper member B is shown in FIG. 9, whereas, two (2) intermediate positions each approximately ⅓ of the full extension shown in FIG. 9 are shown in broken lines in FIGS. 8 and 9 respectively.

It will thus be observed that the adjustable step includes an upper telescopic member carried by a stationary base support and which provide interlocking elements which may be manipulated by manual adjustments to the upper telescopically mounted member utilizing upward translatory movements as well as rotational translatory movement to effect engagement and disengagement of the interlocking elements. Thus, a simple exercise step or stool has been provided for easy access and ready adjustment by a user performing aerobic exercises thereon.

While a preferred embodiment of the invention has been described using specific terms, such description is for illustrative purposes only, and it is to be understood that changes and variations may be made without departing from the spirit or scope of the following claims.

What is claimed is:

1. A height adjustable step for facilitating aerobic exercises thereon comprising:

a substantially cylindrical stationary support including a base and an upwardly extending frame having a single cylindrical wall defining a hollow interior space carried by said base;

a substantially cylindrical moveable upper member including a flat foot receiving upper step surface;

a mounting member including a single cylindrical wall defining a hollow interior space depending from and extending adjacent an outer periphery of said flat foot receiving upper step surface and being substantially coextensive with the outer periphery, and further carrying said upper member in telescopic relation closely adjacent to said upwardly extending frame carried by said base to be supported thereby at adjusted vertical positions thereon;

interlocking members spaced circumferentially about and being carried by opposed cylindrical wall surfaces of said upwardly extending frame and said depending mounting member respectively, at least one of said wall surfaces including circumferentially spaced groups of successively ascending interlocking members projecting outwardly from a substantially cylindrical opposed wall surface to permit relative rotation between said opposed surfaces; and said interlocking members being engageable and disengageable responsive to movement of said upper member by the user of said stationary support at multiple vertical positions about said step for varying the height of said depending mounting member upon said upwardly extending frame;

whereby substantially unobstructed access may be had by the user to an upper step surface which is adjustable in height for varying the exertion expended by the user in exercising, and providing a stable step surface which is readily adjustable in height.

2. The structure set forth in claim 1 wherein said circumferentially spaced groups of successively ascending interlocking members are carried by said upwardly extending frame and by said depending mounting member.

3. The structure set forth in claim 2 wherein said interlocking members include a plurality of upwardly inclined circumferentially spaced surfaces.

4. The structure set forth in claim 3 including an upright slot connecting a lower end of said upwardly inclined surfaces for guiding said interlocking members for raising and lowering said upper member.

5. The structure set forth in claim 2 wherein said interlocking members include pins.

6. The structure set forth in claim 2 wherein said interlocking members include a plurality of vertically spaced upwardly inclined surfaces.

7. The structure set forth in claim 1 wherein said moveable upper member has an open bottom so as to receive said stationary support therein in telescoping relation, whereby rotary motion of said upper member engages and disengages said interlocking elements preparatory to adjusting the height of the step by raising and lowering said upper member.

8. The method of adjusting the height of a step useful for facilitating aerobic exercises thereon comprising the steps of:

providing a stationary support including a base and an upwardly extending frame having a substantially vertical cylindrical wall carried by said base;

providing a moveable upper member including a flat foot receiving upper step surface;

placing a depending mounting member having a substantially vertical cylindrical wall suspended from said upper member in telescopic relation with said upwardly extending frame carried by said base so as to be supported thereby at adjusted vertical positions thereon;

positioning interlocking members in spaced relation about and carried by said upwardly extending frame and said depending mounting member respectively, said interlocking members being engageable and disengageable responsive to movement of said upper member by the user of said stationary support; and engaging and disengaging said interlocking members by moving said upper member manually rotatably and vertically on said stationary support while said upper member is retained upon said upwardly extending frame of said base member without removing said upper member from said upwardly extending frame thereby adjusting said upper member to multiple vertical positions about said step for varying the height of said depending mounting member upon said upwardly extending frame;

whereby substantially unobstructed access may be had in any direction by the user to an upper step surface which is adjustable in height for varying the exertion expended by the user in exercising.

9. The method set forth in claim 8 including providing inclined surfaces as interlocking members in spaced relation about said upwardly extending frame and said depending mounting member.

10. A height adjustable step for facilitating aerobic exercises thereon comprising:

a substantially cylindrical stationary support including a base and an upwardly extending frame having a single cylindrical wall defining a hollow cavity carried by said base;

a substantially cylindrical upper member including a flat foot receiving upper step surface;

a mounting member including a single cylindrical wall defining a hollow cavity depending from and extending adjacent an outer periphery of said flat foot receiving upper step surface and being substantially coextensive with the outer periphery, and further carried by said upper member in telescopic relation with said upwardly extending frame carried by said base to be supported thereby at adjusted vertical positions thereon;

interlocking members spaced circumferentially and vertically about and being carried by opposed surfaces of said upwardly extending frame and said depending mounting member respectively in circumferentially spaced groups of successively ascending interlocking members projecting outwardly from a substantially cylindrical opposed wall surface to permit relative rotation between said opposed surfaces;

said interlocking members being engageable and disengageable responsive to movement of said upper member by the user of said stationary support at multiple vertical positions about said step for varying the height of said depending mounting member upon said upwardly extending frame; and said interlocking members including interlocking surfaces which are inclined slightly rearwardly to maintain engagement during use;

whereby substantially unobstructed access may be had by the user to an upper step surface which is adjustable in height for varying the exertion expended by the user in exercising, and providing a stable upper step surface which is readily adjustable in height.

11. The structure set forth in claim 1 wherein said circumferentially spaced groups of successively ascending interlocking members are carried by said upwardly extending frame.

12. The structure set forth in claim 1, wherein said circumferentially spaced groups of successively ascending interlocking members are carried by said depending mounting member.

* * * * *